US005960849A

United States Patent [19]

Delaney et al.

[11] Patent Number: 5,960,849

[45] Date of Patent: Oct. 5, 1999

[54] CABLE SLACK DETECTOR

[75] Inventors: Charles Edward Delaney, The Colony, Tex.; Robert Edward Balli, Akron, Ohio

[73] Assignee: GMI Holdings, Inc., Alliance, Ohio

[21] Appl. No.: 08/910,402

[22] Filed: Aug. 13, 1997

[51] Int. Cl.[6] ..... B66D 1/58; E05F 15/00

[52] U.S. Cl. ..... 160/188; 160/201; 49/28; 49/199; 254/270; 200/85 R

[58] Field of Search ..... 254/270, 272, 254/273; 160/7, 10, 188, 189, 201; 49/26, 28, 197, 199; 200/85 R

[56] References Cited

U.S. PATENT DOCUMENTS

| | | | |
|---|---|---|---|
| 394,952 | 12/1888 | Baxter, Jr. . | |
| 1,432,058 | 10/1922 | Fogal . | |
| 1,433,079 | 10/1922 | Jett | 254/273 |
| 2,225,003 | 12/1940 | Gorman . | |
| 2,636,953 | 4/1953 | Hunt . | |
| 2,882,044 | 4/1959 | Ginte | 160/189 |
| 3,012,520 | 12/1961 | Curtis . | |
| 3,223,385 | 12/1965 | Murakami | 254/270 |
| 3,532,163 | 10/1970 | Ecuer | 254/273 |
| 3,612,487 | 10/1971 | Raney et al. . | |
| 3,936,622 | 2/1976 | McElroy . | |
| 4,438,903 | 3/1984 | Gagnon et al. | 49/28 |
| 5,348,373 | 9/1994 | Stiennon . | |
| 5,361,565 | 11/1994 | Bayer | 254/280 |
| 5,461,826 | 10/1995 | Heckel et al. | 49/28 |
| 5,477,641 | 12/1995 | Heckel et al. . | |
| 5,698,073 | 12/1997 | Vincenzi | 160/188 |

*Primary Examiner*—John M. Jillions
*Attorney, Agent, or Firm*—Smith, Gambrell & Russell, LLP

[57] ABSTRACT

An apparatus that detects the occurrence of slack in a cable and that compensates for detected slack is disclosed. The apparatus includes body parts that are movable relative to each other between fully extended and fully retracted positions. A bias device biases the body parts toward the fully retracted position. However, normal tension conditions in the monitored cable overcome the bias and extend the body parts to their fully extended relation. If the cable becomes slack, the body parts retract to take up the slack. If the cable slack is to such an extent that the body parts move to a predetermined relative position, the apparatus generates a signal warning of extreme slack conditions. The present invention also is a cable slack control apparatus for a door operator, with such control apparatus including a cable slack detection and compensation device and a door motor drive control device. The present invention further contemplates a method of detecting and compensating for cable slack by reliance on the slack detection and compensation device disclosed herein.

25 Claims, 6 Drawing Sheets

CABLE SLACK DETECTOR

BACKGROUND OF THE INVENTION

The present invention relates to an apparatus that detects the occurrence of slack in a cable, and compensates for detected slack by adding preloaded tension in the cable. The apparatus further generates a warning signal when the slack in the cable exceeds a certain extent. More particularly, the detection and compensation apparatus in accordance with the present invention detects and compensates for slack in the door cable when a door operator lifts and lowers a door by selectively winding and unwinding such cable. The present invention also relates to a door motor drive control system that is equipped with such a cable slack detection and compensation device.

A common, conventional commercial door operator system includes a shaft known as a "jack shaft", a drum mounted on the jack shaft, a cable windable on such drum, and a motor drive for turning the shaft and the drum to selectively wind and unwind the cable. The cable is connected to the door so that the motor lifts the door to open the door by rotating the drum in one direction, and lowers the door by rotating the drum in the opposite direction to pay out the cable. In typical commercial door installations, the door is "balanced"through the cable and paying out the cable allows the door to be closed by gravity. Such a commercial door is lowered by gravity and the lowering speed of the door is controlled by the rate at which the cable is unwound from the drum.

It is important that tension remains in the cable as the door is being lowered. As long as tension remains in the cable, the drum properly will pay out the cable without risk that coils of cable wound on the drum will release from the drum prematurely. Loss of tension in the cable will occur if the door encounters an obstruction, most often in the door opening, as the door is lowered.

Obstruction detection is inherent in residential door operators, but is much more difficult to implement in commercial settings. The typical capacitor start motor powered commercial door operator does not sense when an obstruction impedes or prevents lowering of the door, and consequently the operator will continue to unwind the cable from the drum. Thus, if an obstruction is detected in some other way, such as visually by an operator and then the obstruction is removed, the door will fall suddenly because the cable has developed slack due to having been unwound partially or fully from the drum prior to the detection of the obstruction. This situation leads to obvious danger to people and property below the door, and the door itself, due to uncontrolled door acceleration. Even a small degree of slack potentially is dangerous because under slack conditions, windings of cable can leave the drum and thus lead to the same uncontrolled downward acceleration.

Generally, in hoisting apparatus relying upon a cable for lifting a load, it is conventional to detect and provide alarm conditions when the cable is underloaded or overloaded. For example, U.S. Pat. No. 2,636,953 relates to the use of a slack detection system safety switch. According to the inventor of U.S. Pat. No. 2,636,953, as long as the monitored cable is under sufficient tension, a contracting-bias spring will be extended and a cam follower will have ridden down an inclined cam surface. If slack develops in the monitored cable, the bias spring contracts and the cam follower moves up the incline cam surface to change the condition of a switch and thereby turn off the hoist motor.

U.S. Pat. No. 1,432,058 discloses an early door operator. This operator features a compensating beam that is balanced so that excessive strain will overcome spring force which tends to hold the beam in balance and thus tilt the beam to trigger a switch that provides a signal stopping the motor.

U.S. Pat. No. 394,952 represents an early hoisting arrangement, apparently for an elevator. It protects against both underload and overload on the cable by a contact bar that, during normal conditions, is centered between overload and underload switch contacts.

U.S. Pat. No. 5,361,565 also discloses an elevating system that accounts for overload and underload. It shows a winch assembly equipped with an overload/underload protector. If underload occurs, a compression spring is relieved of pressure and expands to trip an underload limit switch.

U.S. Pat. 3,012,520, also relates to a garage door opener. Springs allow the opening and closing of the door until there is a certain amount of predetermined opposing force preventing door movement.

U.S. Pat. Nos. 5,348,373; 5,461,826; 5,477,641; 2,225,003; 3,936,622; and 3,612,487 also have been noted in regard to detecting underload and/or overload.

What is missing in the conventional arrangements such as those discussed above, is a safety device that is capable of preloading additional tension in the cable to eliminate dangerous slack conditions therein. Then, if the device can not tension the cable sufficiently, the device should signal that the cable still remains slack. This protects against slack conditions in a door operator by equipping the operator to stop the motor immediately from further unwinding the cable when such a slack condition warning signal is received.

SUMMARY OF THE INVENTION

The present invention is a slack cable detection and compensation apparatus ideally suited for commercial door operators, and a door operating system including such a detection and compensation device. The detection and compensation apparatus in accordance with the present invention is mountable to the door and connectable to the door cable.

A preferred detection and compensation apparatus has two relatively movable (slidable) body parts with a stop mechanism for stopping their relative movement at a fully extended (normal) position. The body parts are biased together toward a fully retracted position by a tension spring. The preferred detection and compensation apparatus further includes a position sensor that indicates the relative position of the two body parts. The two body parts are moveable to and from a first position in which the detection and compensation apparatus fully is extended by the tension in the door cable. If there is some degree of slack in the cable, the apparatus will contract from this fully-extended position to a second, intermediate position, in which the apparatus neither is fully extended nor fully retracted.

In the preferred form, the apparatus has a substantial range of relative movement or travel by the two body parts between their fully-extended position and their second or intermediate position. This allows the apparatus to absorb small track pertubations without tripping. This form of the apparatus retracts along this travel range from its fully-extended position to remove slack from the cable. If, however, the extent of slack developed in the cable exceeds the extent to which the apparatus retracts from the fully-extended position to the intermediate position, the apparatus will continue to retract to its fully-retracted position. As the apparatus continues to retract from the intermediate position to its fully-retracted position, the position responsive device thereof generates a warning signal indicating that the device is not capable of removing all of the slack detected in the cable.

In an alternative form, the travel range from the fully extended portion to the intermediate portion is reduced. This provides for earlier generation of the warning signal. This form of the apparatus can have an appreciable travel range between the intermediate position and the fully retracted position in accordance with the objective of slack take up.

In the preferred, exemplary detection and compensation apparatus disclosed in detail in the following, the position sensor is embodied by a device such as a switch circuit. In such an arrangement, a cam follower and a push-button switch of the switch circuit on one of the body parts are actuated when the cam follower engages with a cam surface provided on the other of the body parts. When the apparatus is in its fully extended condition, the cam surface and the cam follower physically are separated and thus the switch is in its unactuated condition. When the two body parts reach their intermediate position, the cam follower and the cam surface come into contact. As the apparatus further retracts, the cam surface causes the cam follower to activate the switch and generate the appropriate warning signal. In this way, the detection and compensation apparatus in accordance with the present invention first attempts to compensate for slack in the door cable, and then, if the extent of slack exceeds the tensioning capabilities of the apparatus, the apparatus causes generation of a warning signal to indicate the continuing slack condition in the door cable.

Thus, under normal operation conditions, the tension in the door cable overcomes the spring force of the tension spring to maintain the body parts in their fully extended condition. However, when the operator cable becomes very slack, the bias spring urges the parts together, which thus activates the position sensor to signal a slack condition to the door operator. Door operation stops in this condition to prevent further unwinding of the cable from the drum. This in turn prevents or at least limits door "free fall".

A door motor drive control system in accordance with the present invention also includes an inhibiting device to selectively inhibit the signal from the slack detection and compensation apparatus. It is contemplated that the inhibiting device responds to when the door essentially is oriented horizontally to generate an inhibit signal. This occurs when the door is fully raised. When the door is horizontal, the inhibiting device generates the inhibit signal to ensure that the slack detection and compensation apparatus will not inadvertently shut off the motor when the cable is expected to become slack temporarily as the door first is being lowered.

Summarized, a cable slack condition detection and compensation apparatus, in accord with the present invention, for connecting a cable to an object for lifting and lowering of the object, comprises: a first body part having a portion connectable to the cable; a second body part having a portion connectable to the object; means for connecting said first body part and said second body part for movement of said body parts relative to each other, said body parts being relatively movable to and from a position in which said apparatus is fully extended, and a position in which said apparatus is fully retracted, said fully extended position and said fully retracted position and positions therebetween defining a range of movement of said body parts; biasing means for biasing said body parts in a direction from said fully extended position toward said fully retracted position, whereby said biasing means moves said body parts from said fully extended position towards said fully retracted position along said movement range in response to a presence of slack in the cable; and means responsive to said relative positions of said body parts for indicating when said biasing means retracts said body parts from said fully extended position to a predetermined position along said movement range, a portion of said movement range from said fully extended position to said predetermined position providing slack compensation prior to indicating by said responsive means.

A cable slack control apparatus for a door operator having a jack shaft, drum means mounted on the jack shaft, a cable windable on the drum means, and drive means for turning the jack shaft, comprises: cable slack condition detection and compensation means for connecting the cable to the door, said detection and compensation means including means for adding tension to the cable to maintain the cable at a minimum tension, and means for providing a slack detection signal when said means for adding tension to the cable is incapable of tensioning the cable to said minimum tension; and drive control means for causing the drive means selectively to turn the jack shaft in a first direction to unwind the cable and lower a door, and a second direction to wind the cable and lift the door, said drive control means including means responsive to a slack detection signal from said compensation means for stopping the drive means.

Alternatively, a cable slack condition detection and compensation apparatus for connecting a cable to an object for lifting and lowering of the object, comprises: a first body part having a portion connectable to the cable and a first planar portion; a second body part having a portion connectable to the object and a second planar portion; means for connecting said first body part and said second body part for sliding movement of said body parts relative to each other along said planar portions thereof, said body parts being relatively movable to and from a position in which said apparatus is fully extended, and a position in which said apparatus is fully retracted, said fully extended position and said fully retracted position and positions therebetween defining a range of movement of said body parts; biasing means for biasing said body parts in a direction from said fully extended position toward said fully retracted position along said movement range in response to a presence of slack in the cable; and means responsive to said relative positions of said body parts for indicating when said biasing means moves said body parts from said fully extended position to a predetermined position along said movement range.

Also a method of detecting and compensating for slack in a cable used for lifting and lowering an object, comprises the steps of: providing an apparatus including two body portions connected to each other so that they are movable relative to each other to and from a first position in which said body portions are fully extended with respect to each other, and a second position in which said body portions are fully retracted with respect to each other, said first and second positions and positions therebetween defining a range of movement of said body portions, and means for generating a warning signal when said body portions retract from said first position toward said second position to a predetermined position; connecting one of said body portions to said cable and the other of said body portions to said object; biasing said body portions toward said second position against tension in said cable, whereby when said cable becomes slack, said biasing means moves said body portions from said first position toward said second position in order to take up slack in said cable; sensing when said body portions retract from said first position to said predetermined position; and causing said generating means to generate said warning signal upon sensing that said body portions have retracted to said predetermined position.

BRIEF DESCRIPTION OF THE DRAWINGS

Further aspects and features of the present invention will be even more apparent from the following detailed description and drawings, and the appended claims. In the drawings:

DETAILED DESCRIPTION OF THE PREFERRED EMBODIMENTS

For reference, we first show an example of a conventional door assembly 10. Door assembly 10 is of the commercial type which benefits greatly from installation of a cable slack condition detection and compensation apparatus in accordance with the present invention to make operation of door assembly much safer.

Figure 10:
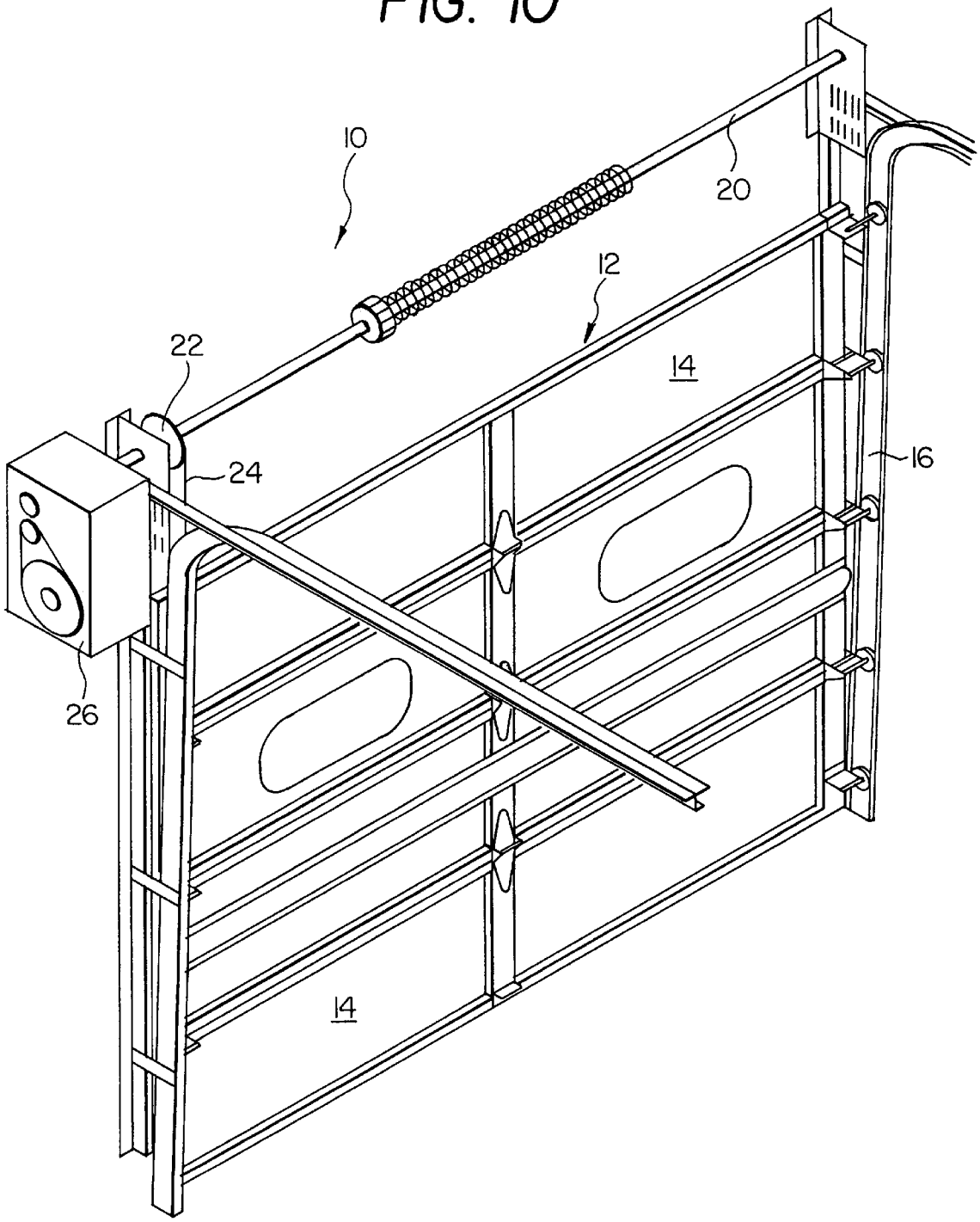
FIG. 10 is a perspective view of a conventional door assembly and conventional door operator equipment for raising and lowering the door.

From FIG. 10, the major elements of commercial door assembly 10 are seen. Door 12 includes multiple panels 14 hinged together to permit movement along the door track 16. The door operating system for lifting and lowering door 12 includes a jack shaft 20 that spans the width of the door. Upon jack shaft 20 is mounted a cable drum 22 for winding and paying out a cable 24 to lift and lower door 12. A drive motor assembly 26 rotates drum 22 to wind or unwind cable 24 . Door 12 is balanced so that it will close under its own weight when the drive motor unwinds the cable 24 from drum 22. While door assembly 10 is depicted with only one drum 22 and cable 24, it is common practice that a like drum and cable would be provided on the opposite end of jack shaft 20 (the right-hand side of door 12 in FIG. 10). Control over the drive motor assembly 26 will be discussed further in detail in the following.

Figure 11:
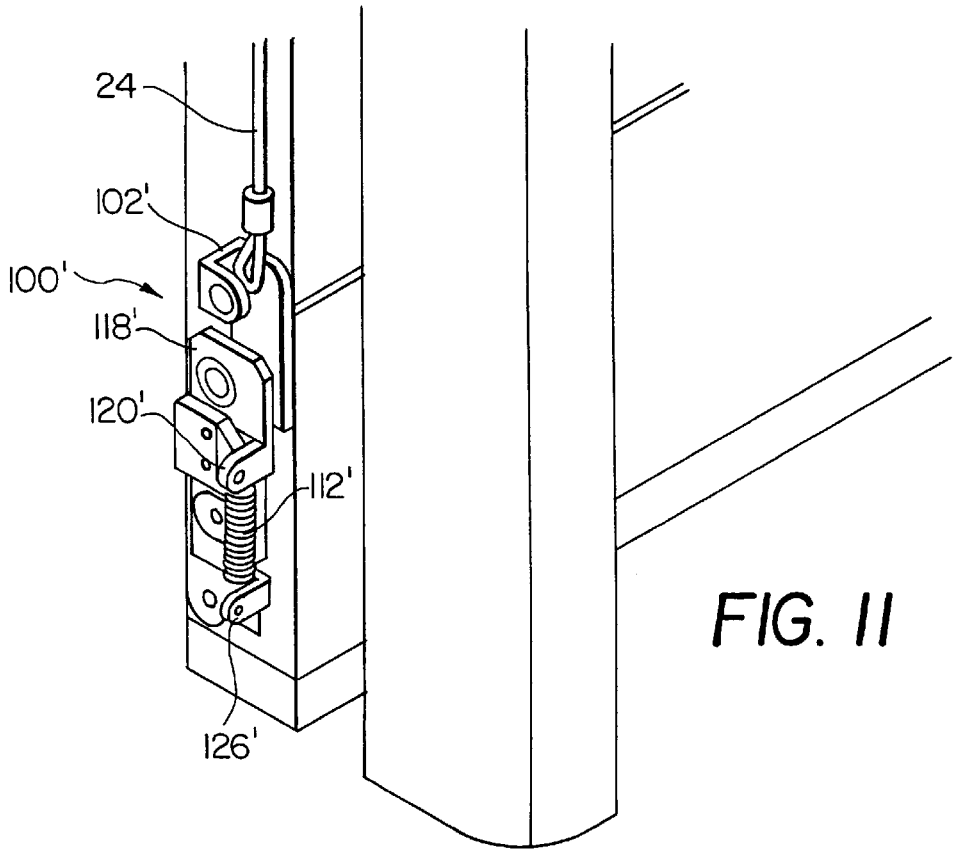
FIG. 11 is a perspective view showing an alternative embodiment of the slack detection and compensation apparatus of the present invention as mounted to the door and operatively connected to the door cable.

With reference now to FIG. 11, for illustrative purposes, we show the placement and mounting of a preferred form of a cable slack condition detection and compensation apparatus 100'. FIG. 11 corresponds to the left, lower most corner of the door assembly 10 of FIG. 10. As such, it is appreciated that FIG. 11 shows apparatus 100' mounted to the left-hand, lower most portion of the door 12, for connection with the door cable 24 . It should be kept in mind that if assembly 10 included a right-side drum 22 and cable 24, another such apparatus 100' would be mounted to the right-hand, lower most portion of the door. As will be described in detail, apparatus 100' so connected to door cable 24, acts to take up slack in the door cable if slack develops in the cable, and if the slack exceeds a certain extent, the apparatus generates a signal to prevent the drive motor assembly 26 from lowering door 12. The embodiment of FIG. 11 will be discussed in more detail infra.

FIGS. 1 through 9 are different views of a preferred implementation of a cable slack condition detection and compensation apparatus 100 in accordance with the present invention. To introduce details of the inventive device, it is convenient, initially, to refer to FIGS. 1 through 3. There, detection and compensation apparatus 100 is seen to include a first body part 102 that has a U-shaped portion 104 adapting the apparatus for connection with a door cable such as seen in FIG. 11. A second body part 106 rests on the first or cable-connecting body part 102 and the second or mounting body part 106 are secured together by a connecting assembly generally identified by reference numeral 110. Body parts 102 and 106 and the connecting structure 110 are arranged so that the body parts are slidable relative to each other against the bias imparted by a coil spring 112 .

Cable-connecting body part 102 primarily is a flat member with two raised portions and an elongate slot. As mentioned previously, one of the raised portions is the U-shaped portion 104 for connection to the door cable. At its opposite end, connecting part 102, has a stop 114 which like U-shaped portion 104 integrally is formed with the connecting part. Connecting part 102 further includes a first protrusion 116 which supports a position sensor 118. A second protrusion, generally opposite the supporting protrusion 116, provides a first arm 120 for connecting bias spring 112 . Also, in the preferred form of slack condition detection and compensation apparatus 100 as shown in FIGS. 1 through 9, an elongate slot 122 extends longitudinally substantially along the length of the flat area of cable connecting part 102.

In preferred apparatus 100, the mounting part or member 106 is substantially completely flat. It has two bores (not shown) which each receive a bolt-and-nut 124 for coupling body parts 102 and 106 so that they slide with respect to one another along the length of slot 122. Mounting part 106 provides the second arm 126, opposing the first arm 120 of the connecting part 102, for attachment of spring 112 . At its upper portion mounting body part 106 has an upstanding shoulder 128 that faces stop 114 in opposition to control the extent of relative movement of the two sliding body parts. The edge 130 which defines shoulder 128 leads to a horizontal section 132 of a cam surface generally referred to as surface 134. At a forward-most portion of mounting part 106 (the left-most portion in FIGS. 1 and 2), horizontal cam surface section 132 intersects with an inclined section 138 which slopes upwardly, rearwardly from a vertical forward edge 136 of the mounting part to connect with the horizontal section.

Figure 1:
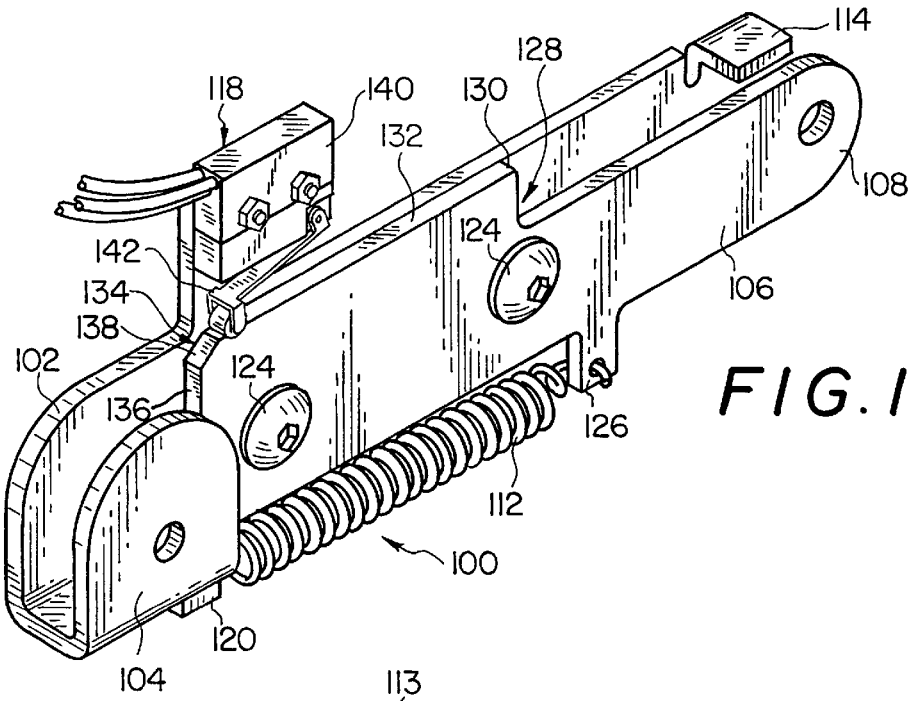
FIG. 1 is a perspective view of a preferred embodiment of a cable slack detection and compensation apparatus in accordance with the present invention.
Figure 2:
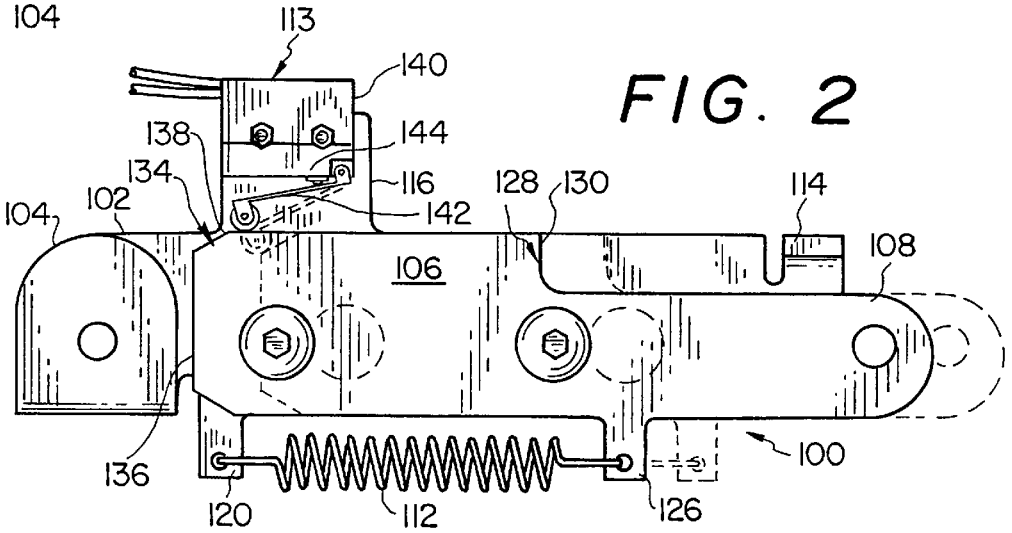
FIG. 2 is a plan view of one side of the apparatus of FIG. 1, with phantom lines showing the intermediate position of the body parts and the resulting position of the position sensor.
Figure 3:
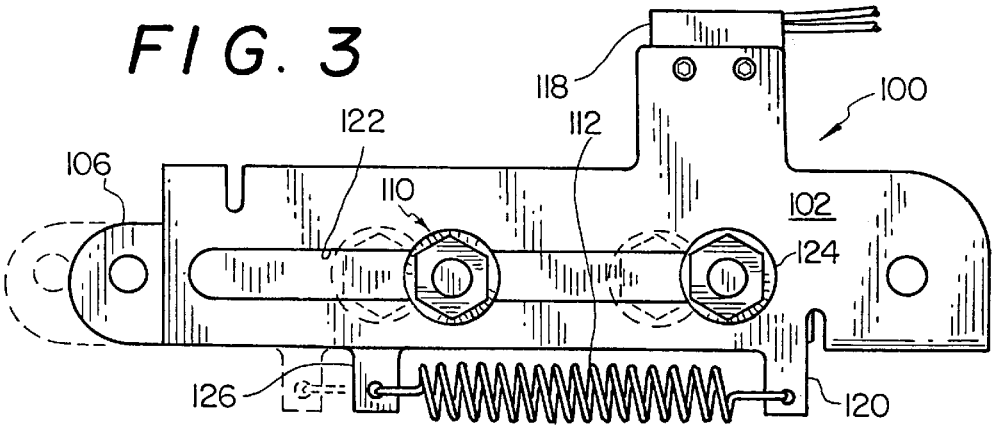
FIG. 3 is a plan view similar to FIG. 2, of the opposite side of the apparatus of FIGS. 1 and 2.
Figure 4:
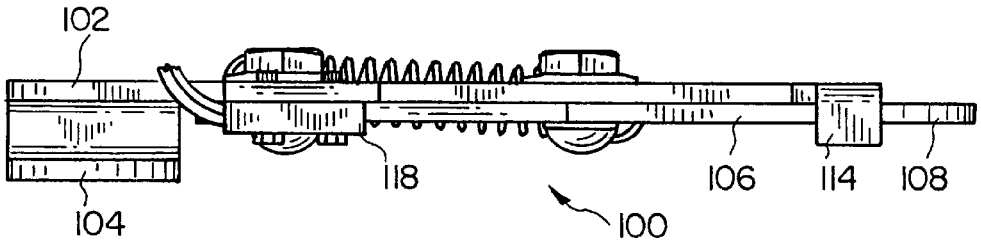
FIG. 4 is a downwardly-looking view of the apparatus as shown in FIG. 1.
Figure 5:
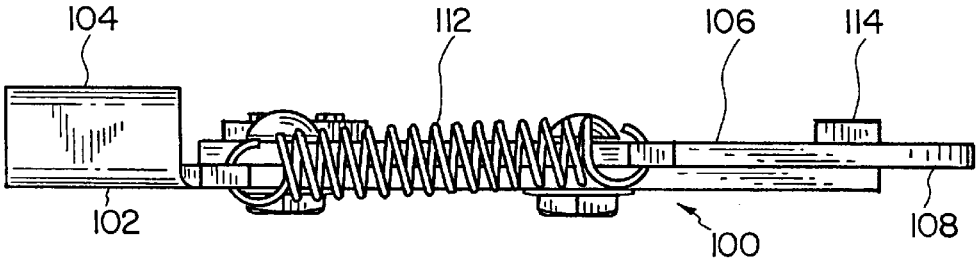
FIG. 5 is an upwardly-looking view of the apparatus as shown in FIG. 1.
Figure 6:
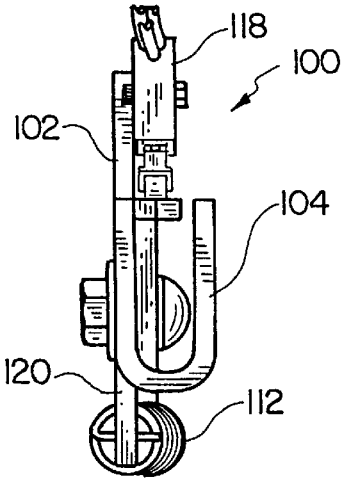
FIG. 6 is a front view of the apparatus as shown in FIG. 1.
Figure 7:
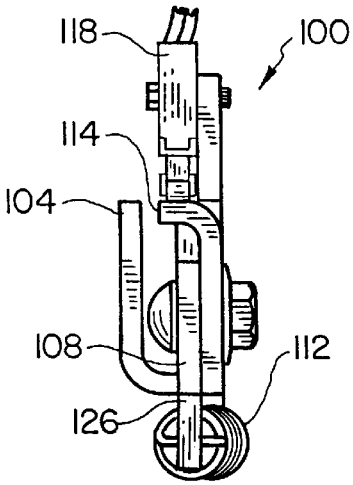
FIG. 7 is a rear view of the apparatus as shown in FIG. 1.
Figure 8:
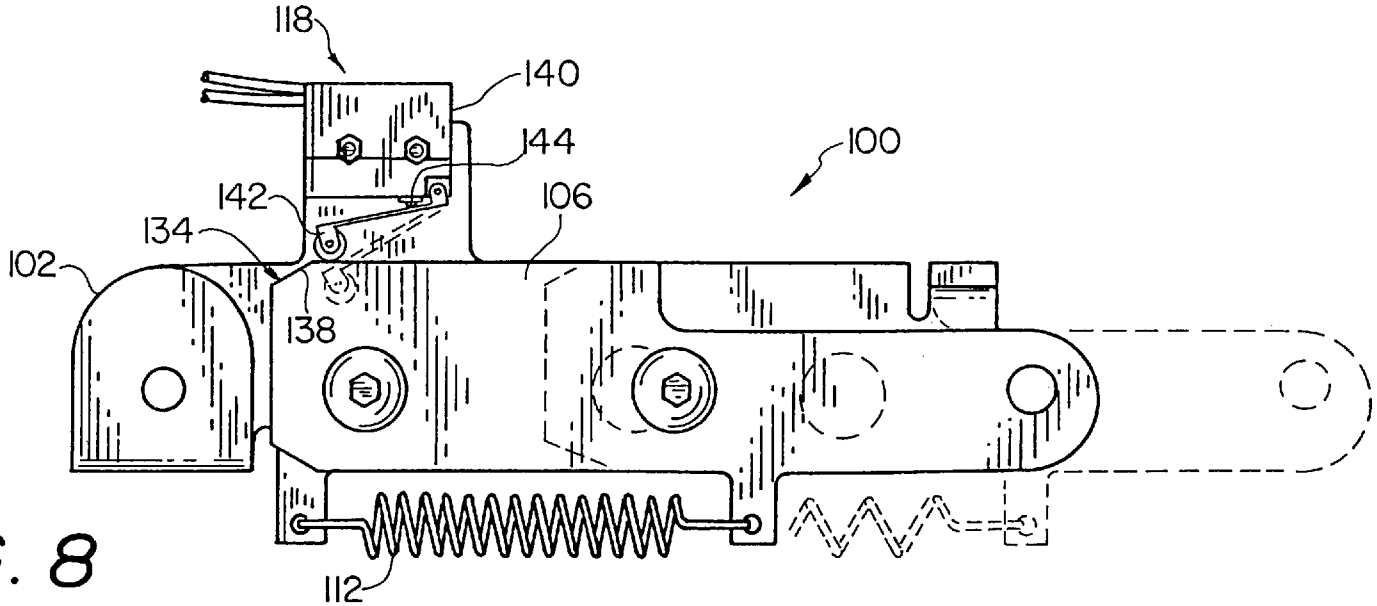
FIG. 8 is a view similar to FIG. 2, with the fully-extended position of the apparatus being shown in phantom.
Figure 9:
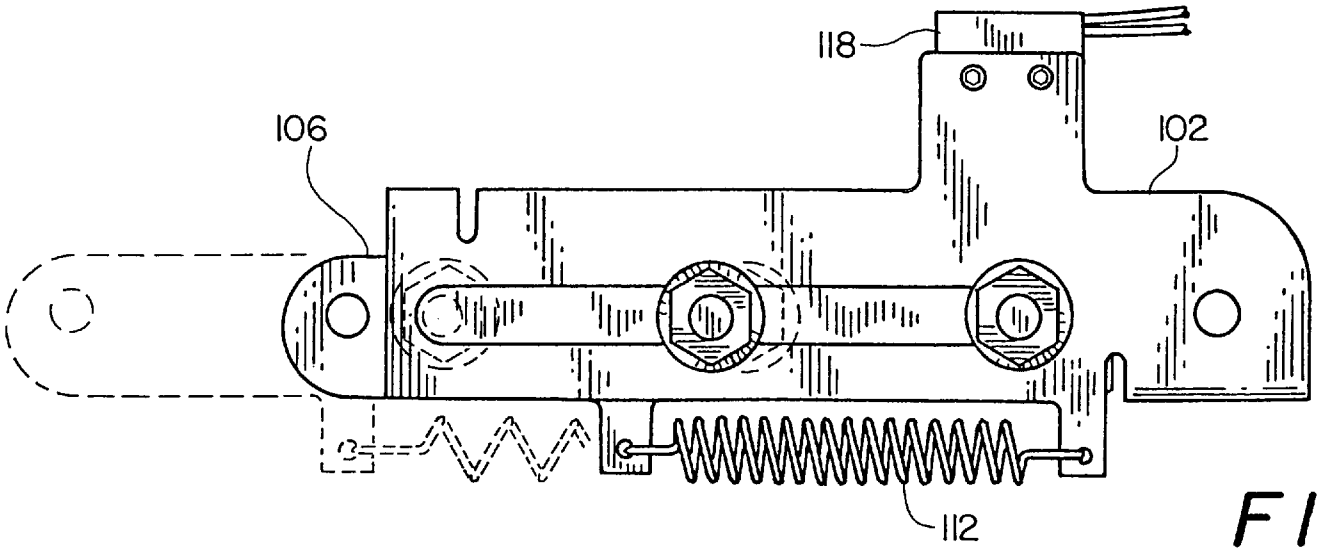
FIG. 9 is a view, similar to FIG. 3, that like FIG. 8, shows the fully-extended position of the apparatus in phantom.

Position sensor 118 includes a sensor switch assembly 140 mounted to the upstanding protrusion 116 of connection part 102 . Sensor switch 140 is conventional and preferably is of a sealed type such as model DCIC-D4RB by Cherry Corporation. When slack condition detection and compensation apparatus 100 is in its fully retracted position shown in FIGS. 1–3, a cam following switch arm 142 rides on the horizontal section 132 of cam surface 134 so that the switch arm thereof continually actuates push-button switch 144. Activation of push-button switch 144 switches a circuit to place it in an ON or ALARM state and provide a signal indicative of the relative position of body parts 102 and 106. On the other hand, when body parts 102 and 106 are in their fully-extended relative positions as shown in FIGS. 8 and 9, cam follower 142 and the cam surface 134 are isolated from each other whereby follower arm 142 lowers due to gravity, leaving switch assembly 140 in its normal open or OFF condition with no pressure applied to push-button 144 .

Those of ordinary skill in the art will appreciate that other position sensing arrangements could be used in place of switch assembly 140 in connection with cam surface 134. For instance, an optical device with a transmitter mounted to one of the body parts and a receiver mounted to the other likewise could detect the relative position of the body parts. Alternatively, a magnetic sensing arrangement with a sensing device on one body part and a sensed device on the other could be employed. Other such position sensing devices, as would be apparent to those of ordinary skill, likewise could be substituted.

FIGS. 4 through 7 provide top and bottom, and front and rear views of detection and compensation apparatus 100 in detail. These drawings, taken with FIGS. 1 through 3, 8, and 9, thus clearly show the positions of each of the elements making up the preferred apparatus 100.

Normally, significant tension will be present in the door cable. Cable tension is attributed to the weight of the door. The tension present in the door cable overcomes the contracting bias of spring 112 and thus causes apparatus 100 to extend to its fully-extended position shown in phantom in FIGS. 8 and 9. In this position, shoulder 128 and stop 114 are in contact while cam follower 142 and cam surface 134 are separated completely. In this condition, position sensor 118 controls a circuit to indicate that the apparatus 100 detects that tension properly is present within the cable.

If slack develops in the cable, apparatus 100 begins to retract under the bias of spring 112. This acts to tension the cable to a minimum tension imparted to the cable by bias spring 112. Before it causes generatation of an ALARM signal, apparatus 100 has the capacity to take up slack in the cable to the extent that it retracts from its fully-extended position as shown in phantom in FIGS. 8 and 9 to an intermediate position at which cam follower 142 just contacts and begins to ride up inclined cam surface section 138. The intermediate position of body parts 102 and 106 where cam follower 142 just begins to engage inclined cam surface 138 is shown in phantom in FIG. 2. As the cam follower 142 rides up cam surface section 138, the cam follower soon reaches an actuating position at which the follower arm contacts and actuates push-button switch 144 . In this condition, switch assembly 140 causes generation of the warning or ALARM signal indicating that apparatus 100 is incapable of compensating for the degree of slack present in the door cable. Bias spring 112, meanwhile, will continue to retract body parts 102 and 106 to their fully closed or retracted position.

Those of ordinary skill in the art now will appreciate that, in addition to alternative position sensors, other alternative elements are useful in a slack detection and compensation apparatus in accordance with the invention. Preferred apparatus 100 (and 100') has generally flat body parts to facilitate sliding movement relative to each other. However, other arrangements of relatively movable parts can be implemented provided they are connected in a way to provide them with a range of motion for the take up of slack before reaching a final position at which they are incapable of taking up further slack. Moreover, different connecting arrangements for different body parts, to provide for the slack take up range of motion, now will be apparent to those of ordinary skill in the art. For instance, a track assembly could be substituted for connecting arrangement 110. Further still, we contemplate that the body parts could be connected at one end by a connective assembly (such as a journal or a hinge) and by a biasing device so that the body parts form an angle between them that can be changed depending upon whether there is slack in the cable.

Figure 12:
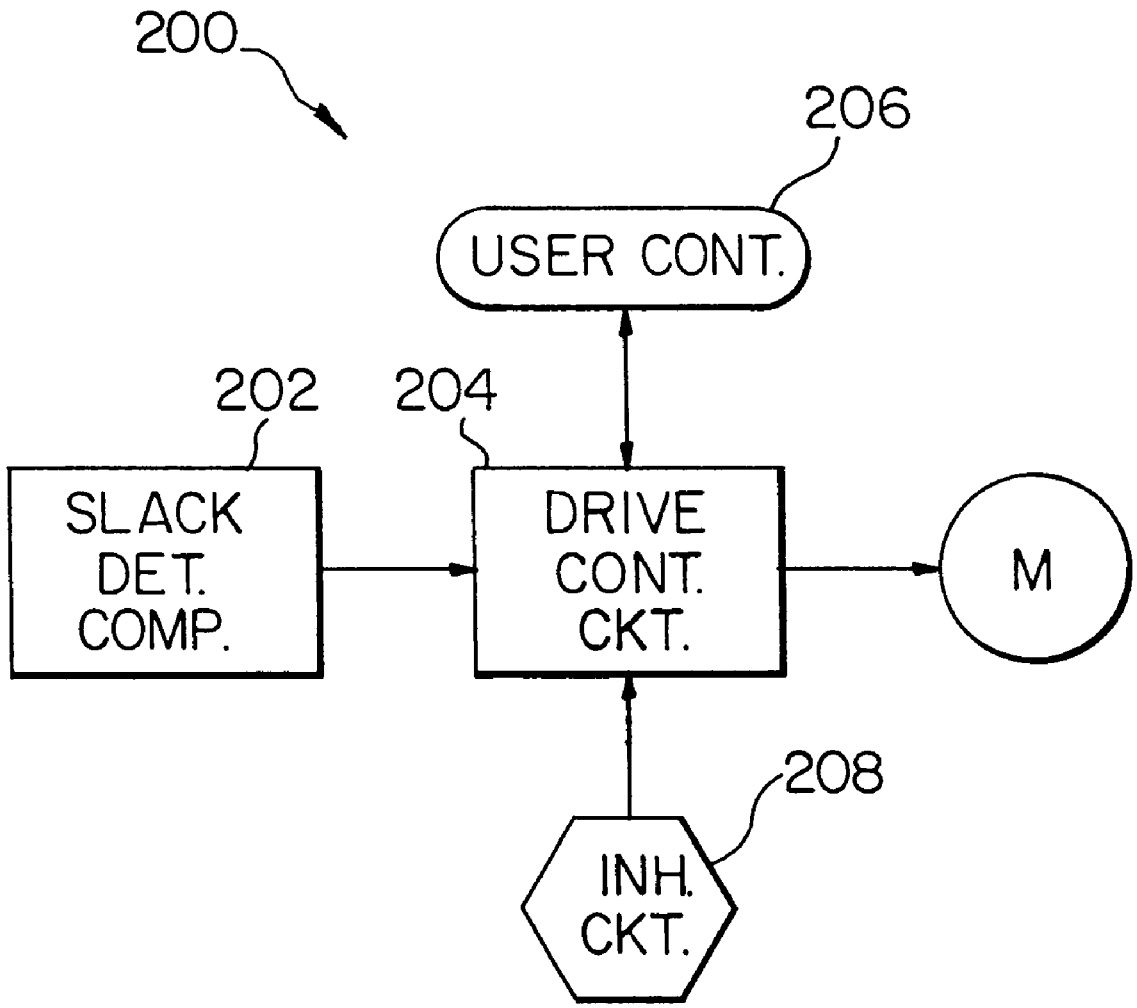
FIG. 12 is a block diagram of a door motor drive control system in accordance with the present invention.

FIG. 12 shows a cable slack compensation and control system 200 also in accordance with the present invention. System 200 includes a slack condition detection and compensation apparatus in accord with the invention, which apparatus has been identified by reference numeral 202 in FIG. 12. Slack detector and compensator 202 provides an input to a door drive control circuit 204. Sensor switch 140 is considered part of door drive control circuit 204 because the condition of its switch 144 informs the door drive control circuit as to the tension conditions in the door cable 24 (FIGS. 10 and 11). When the cable 24 is under normal tension, or at least under the minimum tension that is imparted thereto by detection and compensation apparatus 202, the door drive control circuit 204 will operate the motor M in accordance with commands to open or close the door as input from user control switch panel 206.

Control system 200 also includes an inhibit circuit 208 for selectively inhibiting response by the door control circuit to a slack warning signal from the slack detection and compensation apparatus 202. Inhibiting circuit 208 is present to prevent the door drive control circuit 200 from stopping the motor when slack temporarily is expected to be present in the cable. This occurs when the door first is being lowered from its fully open position. At this time, slack commonly is present in the door cable, and during this time, a slack warning signal from detector/compensator 202 must be inhibited in order to prevent the drive circuit 204 from turning off the motor M. It is contemplated that preferred door control system 200 incorporates a conventional tilt sensor (not shown) mounted near the bottom of the door as an element of the inhibiting circuit 208. Including such a tilt sensor, inhibiting circuit 208 provides a signal whenever the door is nearly horizontal, corresponding to when the door is in its substantially fully open position. As the door moves toward closing, the inhibit signal from circuit 208 terminates whereupon door drive control circuit 204 again becomes completely responsive to a slack warning signal from slack detection and compensation apparatus 202.

Figure 13:
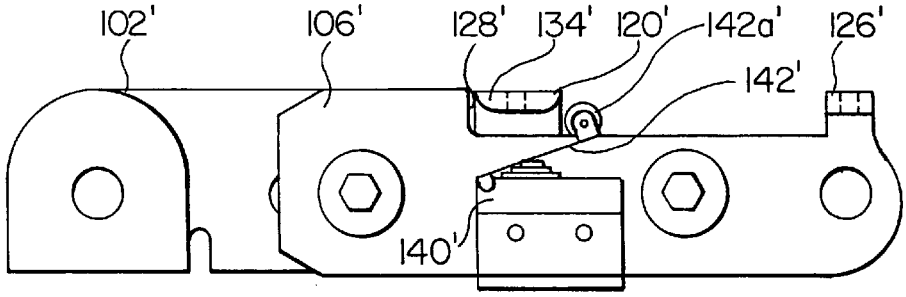
FIG. 13 is a plan view of one side of the embodiment of FIG. 11.
Figure 14:
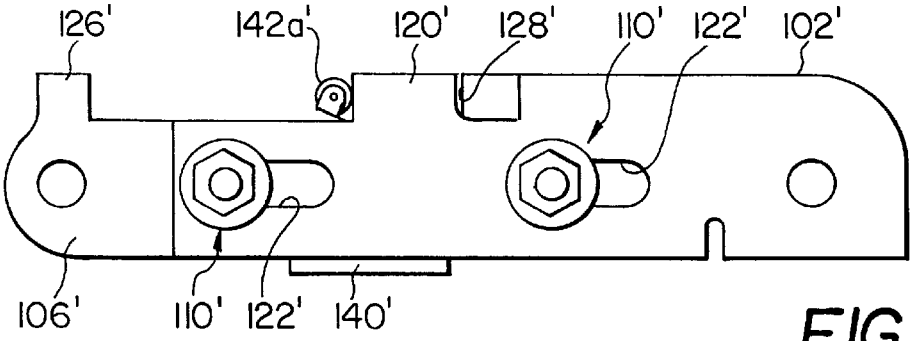
FIG. 14 is a plan view of the other side of the embodiment of FIG. 11.

At this time, we return to FIG. 11, and also consider FIGS. 13 and 14. These figures show the alternative arrangement for slack detection and compensation apparatus 100'. Apparatus 100' features two relatively sliding body parts 102' and 106'. However, in apparatus 100', the relative travel distance between the body parts 102' and 106' has been reduced, and the switch assembly 140' thereof is arranged for actuation to occur earlier than that of apparatus 100.

From FIG. 11, it first is apparent that the orientation of the bias spring-holding arms 120' and 126' is modified so that they are perpendicular to the planes of body parts 102' and 106'. This arrangement for the spring-holding arms 120' and 126' further spaces the bias spring 112' away from the door 12 and the door track 16.

The primary difference of apparatus 100' over that of apparatus 100 is the reduction in travel length between the fully extended position of body parts 102' and 106' and their intermediate position at which the cam follower 142' of the switch assembly 140' comes into contact with the cam surface 134'. FIGS. 13 and 14 omit the bias spring 112' in order to more clearly illustrate the relatively close proximity between the cam follower roller 142' and the cam surface 134' which, in the embodiment of apparatus 100', is provided by spring arm 120'. As thus seen from FIGS. 13 and 14, body parts 102' and 106' do not have a portion such as protrusion 116 and instead, switch assembly 140' is mounted on the door-mountable body part 106', on the side opposite to that which slides against body part 102'. (Thus by omitting such protrusion, apparatus 100' has the advantage of decreased weight in that preferred apparatus 100 and 100' each are contemplated as constructed from steel, or like metals.) Actually, as also seen, the underside surface of spring arm 120' provides the cam surface 134' for actuating the switch 140'. From FIGS. 13 and 14, it is seen that the follower roller 142*a'* is in relatively close proximity to the cam surface 134' even when apparatus 100' is in its fully extended position. As such, apparatus 100' has a lesser travel distance for taking up slack in the cable 24 prior to when the cam follower 142' and cam surface 134' will engage to trigger the switch 140' and thus cause generation of the alarm signal. Apparatus 100' thus provides an arrangement where the alarm signal is generated earlier if slack occurs in the cable 24. It also now is apparent to those of ordinary skill that the travel range between the fully extended position, and the intermediate position at which the alarm signal is triggered, is dependent upon where switch assembly 140' is mounted on body part 106'. Changing the position at which switch 140' is mounted on part 106' results in a change of the pre-alarm compensation length. (If desired, the actuating position for causing the warning signal can be set to correspond to the fully retracted position of the body parts 102' and 106' (or 102, 106).)

On the other hand, apparatus 100', as shown, has a longer travel range for slack take up after the alarm signal has been generated. Apparatus 100' also compensates for slack in the cable but generates the alarm signal when there is a lesser extent of slack within the cable.

Spring arm 120' also performs a third function in apparatus 100'. Because it is substantially perpendicular to the plane of its body part 103', spring arm 120' also is positioned to engage with the shoulder 128' of body part 106' to thus act as the stop for apparatus 100'.

Apparatus 100' further is seen to have a connecting arrangement 110' that has a pair of slots 122'. The travel range permitted by slots 122' is somewhat less than that accorded by slot 122 and apparatus 100. Otherwise, those of ordinary skill in the art will appreciate that the single slot or the paired slot arrangement is applicable in either of embodiments 100 or 100'.

In operation, the detection and compensation apparatus 100 (or 100') simply is mounted to the lower part of the door 12 by any conventional fastener as understood from FIG. 11. Reference will be made to apparatus 100. The fastener extends through the mounting portion 108 of mounting part 106. The door cable attaches to the U-shaped portion 104 of cable-connecting portion 102. Thereafter, the apparatus 100 (or 100') is in place for monitoring tension within the door cable 24.

Normally, tension in the door cable maintains apparatus 100 in the fully-extended condition as shown in phantom in FIGS. 8 and 9. If slack begins to develop in the cable, the apparatus automatically begins to compensate by the contraction of spring 112 . As apparatus 100 retracts, forward edge 136 moves toward the cam follower 142 . If the degree of slack exceeds the range of motion permitted between the fully extended position of FIGS. 8 and 9 (in phantom) and the position where cam follower 142 just contacts inclining cam surface section 138, the cam follower moves up the incline section far enough to depress push-button and thereby generate a slack warning signal.

With reference also to FIG. 12, door drive control circuit 204 operates to drive the motor M to close the door or open the door in response to user commands entered at the control switch panel 206 . However, when slack detection and compensation apparatus 202 applies a slack warning signal to door drive control circuit 204, the drive control circuit automatically at least stops the motor M from further rotating the drum (e.g. drum 26 in FIG. 10) in order to eliminate further pay out of the door cable (e.g. cable 24 in FIG. 11). As also apparent to those of ordinary skill in the art, door drive control circuit 204 could begin to wind the cable to take up slack within the cable. Further, drive control circuit 204 can be implemented to continue to wind the cable in order to raise the door and thereby enable removal of an obstruction, if the cause of the detected slack condition was the result of an obstruction. Further, inhibiting circuit 208 monitors the position of the door in order to inhibit drive control circuit 204 from improperly responding to a warning signal from slack detection and compensation apparatus 202 when the door is in a substantially horizontal position. As mentioned in the foregoing, this selectively prevents slack detection and compensation apparatus 202 from interfering with routine lowering of the door from the fully-open position of the door where the door is oriented substantially horizontally.

If it is desired to generate the detected slack or warning signal earlier than would be done by apparatus 100, alternative apparatus 100' can be substituted for apparatus 100 in control system 200. Apparatus 100' will generate the detection signal in the presence of a lesser extent of slack in the cable in order to signal the control system 200 earlier that the cable is becoming slack. Apparatus 100' however, continues to compensate for slack even after it begins to generate the detection signal due to increased travel range between its actuating position and its fully retracted position.

It is to be understood that there can be various changes and modifications to the preferred embodiments of the present invention disclosed herein, which changes and/or modifications may be made by of one of ordinary skill in the art. However, such would still result in an arrangement well within the scope of the invention as set forth in the claims.

What is claimed is:

1. A cable slack condition detection and compensation apparatus for connecting a cable to an object for lifting and lowering of the object, said apparatus comprising:

a first body part having a portion connectable to the cable;

a second body part having a portion connectable to the object;

means for connecting said first body part and said second body part for movement of said body parts relative to each other, said body parts being relatively movable to and from a position in which said apparatus is fully extended, and a position in which said apparatus is fully retracted, said fully extended position and said fully retracted position and positions therebetween defining a range of movement of said body parts;

biasing means for biasing said body parts in a direction from said fully extended position toward said fully retracted position, whereby said biasing means moves said body parts from said fully extended position towards said fully retracted position along said movement range in response to a presence of slack in the cable; and means responsive to said relative positions of said body parts for indicating when said biasing means retracts said body parts from said fully extended position to a predetermined position along said movement range, a portion of said movement range from said fully extended position to said predetermined position providing slack compensation prior to indicating by said responsive means, and wherein said portion of said movement range providing slack compensation exceeds a portion of said range of movement of said body parts between said predetermined position and said fully retracted position.

2. A cable slack condition detection and compensation apparatus as claimed in claim 1, wherein said responsive means includes electronic means and said responsive means performs said indicating by switching an electronic circuit.

3. A cable slack condition detection and compensation apparatus as claimed in claim 2, wherein, said electronic means includes an electronic switch;

one of said body parts has a cam surface; and said detection and compensation apparatus includes a cam follower disposed between said switch and said cam surface for actuating said switch when said cam surface and said cam follower move relative to each other to an actuating position, said cam surface and said cam follower moving to said actuating position when said biasing means biases said body parts to said predetermined position.

4. A cable slack detection and compensation apparatus for connecting a cable to an object for lifting and lowering of the object, said apparatus comprising:

a first body part having a portion connectable to the cable;

a second body part having a portion connectable to the object;

means for connecting said first body part and said second body part for movement of said body parts relative to each other, said body parts being relatively moveable to and from a position in which said apparatus is fully extended, and a position in which said apparatus is fully retracted, said fully extended position and said fully retracted position and positions therebetween defining a range of movement of said body parts;

biasing means for biasing said body parts in a direction from said fully extended position toward said fully retracted position, whereby said biasing means moves said body parts from said fully extended position towards said fully retracted position along said movement range in response to a presence of slack in the cable; and means responsive to said relative positions of said body parts for indicating when said biasing means retracts said body parts from said fully extended position to a predetermined position along said movement range, a portion of said movement range from said fully extended position to said predetermined position providing slack compensation prior to indicting by said responsive means and, wherein one of said body parts has a slot extending longitudinally therein, and the other of said body parts has a member projecting into said slot for defining said relative movement with said slot, said slot and said member providing said connecting means;

said body parts each have a flat portion, and said relative movement is relative sliding movement of said flat portions; and one of said body parts has a stop, and the other of said body parts has a shoulder facing in opposition to said stop, said stop and said shoulder cooperating to prevent extending movement beyond said fully extended position.

5. A cable slack condition detection and compensation apparatus as claimed in claim 4, wherein a portion of said range of movement of said body parts between said predetermined position and said fully retracted position exceeds said portion of said range of movement of said body parts between said fully extended position and said predetermined position.

6. A cable slack detection and compensation apparatus as claimed in claim 4, wherein each of said body parts has a protruding arm, and said biasing means includes a spring with one end thereof connected to said protruding arm of one of said body parts and an opposite end thereof connected to said arm of the other body part; and one of said body parts includes a mounting portion for mounting said responsive means to determine the extent of each of said portions of said range of motion.

7. A cable slack condition detection and compensation apparatus as claimed in claim 4, wherein said responsive means includes electronic means and said responsive means performs said indicating by switching an electronic circuit.

8. A cable slack condition detection and compensation apparatus as claimed in claim 7, wherein, said electronic means includes an electronic switch;

one of said body parts has a cam surface; and said detection and compensation apparatus includes a cam follower disposed between said switch and said cam surface for actuating said switch when said cam surface and said cam follower move relative to each other to an actuating position, said cam surface and said cam follower moving to said actuating position when said biasing means biases said body parts to said predetermined position.

9. A cable slack condition detection and compensation apparatus as claimed in claim 8, wherein said portion of said range of movement of said body parts between said fully extended position and said predetermined position exceeds a portion of said range of movement of said body parts between said predetermined position and said fully retracted position.

10. A cable slack control apparatus for a door operator having a jack shaft, drum means mounted on the jack shaft, a cable windable on the drum means, and drive means for turning the jack shaft, said apparatus comprising:

cable slack condition detection and compensation means for connecting the cable to the door, said detection and compensation means including means for adding tension to the cable to maintain the cable at a minimum acceptable tension, and means for providing a slack detection signal when said means for adding tension to the cable is incapable of tensioning the cable to said minimum tension; and drive control means for causing the drive means selectively to turn the jack shaft in a first direction to unwind the cable and lower a door, and a second direction to wind the cable and lift the door, said drive control means including means responsive to a slack detection signal from said compensation means for stopping the drive means, and wherein said means for adding tension includes a first body part, a second body part, means for connecting said first body part and said second body part for movement of said body parts relative to each other, said body parts being relatively movable to and from a position in which said apparatus is fully extended, and a position in which said apparatus is fully retracted, said fully extended position and said fully retracted position and positions therebetween defining a range of movement of said body parts, and biasing means for biasing said body parts in a direction from said fully extended position toward said fully retracted position along said movement range in response to a presence of slack in the cable, and wherein one of said body parts has a slot extending longitudinally therein, and the other of said body parts has a member protecting into said slot for providing said relative movement;

one of said body parts has a stop for preventing said relative movement beyond said fully extended position, and the other of said body parts has a shoulder facing in opposition to said stop; and each of said body portions has a protruding arm, and said biasing means includes a spring with one end thereof connected to said protruding arm of one of said body portions and an opposite end thereof connected to said arm of the other body portion.

11. A cable slack control apparatus as claimed in claim 10, further comprising inhibiting means, responsive to a position of the door, for generating an inhibit signal for inhibiting response by said drive control means to a slack detection signal from said cable slack detection and compensation means.

12. A cable slack control apparatus as claimed in claim 8 wherein said body parts each have a flat portion, and said relative movement is sliding movement of said flat portions.

13. A cable slack control apparatus as claimed in claim 8, wherein said means for providing a slack detection signal includes electronic switch means.

14. A cable slack control apparatus as claimed in claim 13, wherein one of said body parts has a cam surface; and said compensation apparatus includes a cam follower disposed between said switch means and said cam surface for actuating said switch means when said cam surface and said cam follower move relative to each other to an actuating position, said cam surface and said cam follower moving to said actuating position when said biasing means biases said body parts to a predetermined position intermediate said fully extended position and said fully retracted position.

15. A cable control apparatus as claimed in claim 14, wherein a portion of said range of movement of said body parts between said fully extended position and said predetermined position exceeds a portion of said range of movement of said body parts between said predetermined position and said fully retracted position.

16. A cable control apparatus as claimed in claim 14, wherein a portion of said range of movement of said body parts between said predetermined position and said fully retracted position exceeds a portion of said range of movement of said body parts between said fully extended position and said predetermined position.

17. A cable slack condition detection and compensation apparatus for connecting a cable to an object for lifting and lowering of the object, said apparatus comprising:

a first body part having a portion connectable to the cable and a first planar portion;

a second body part having a portion connectable to the object and a second planar portion;

means for connecting said first body part and said second body part for sliding movement of said body parts relative to each other along said planar portions thereof, said body parts being relatively movable to and from a position in which said apparatus is fully extended, and a position in which said apparatus is fully retracted, said fully extended position and said fully retracted position and positions therebetween defining a range of movement of said body parts;

biasing means for biasing said body parts in a direction from said fully extended position toward said fully retracted position along said movement range in response to a presence of slack in the cable; and means responsive to said relative positions of said body parts for indicating when said biasing means moves said body parts from said fully extended position to a predetermined position along said movement range.

18. A cable slack condition detection and compensation apparatus as claimed in claim 17, wherein said responsive means includes electronic means and said responsive means performs said indicating by switching an electronic circuit.

19. A cable slack condition detection and compensation apparatus as claimed in claim 18, wherein said responsive means includes first means on one of said body parts and second means on the other of said body parts, said second means switching said electronic circuit in response to a positional relationship between said first means and said second means.

20. A cable slack condition detection and compensation apparatus as claimed in claim 19, wherein, said first means is a cam surface; and said second means is an electronic switch including a cam follower, said cam surface actuating said switch when said cam surface and said cam follower move relative to each other to an actuating position, said cam surface and said cam follower moving to said actuating position when said biasing means biases said body parts to said predetermined position.

21. A cable slack condition detection and compensation apparatus as claimed in claim 20, wherein a portion of said range of movement of said body parts between said fully extended position and said predetermined position exceeds a portion of said range of movement of said body parts between said predetermined position and said fully retracted position.

22. A cable slack condition detection and compensation apparatus as claimed in claim 20, wherein a portion of said range of movement of said body parts between said predetermined position and said fully retracted position exceeds a portion of said range of movement of said body parts between said fully extended position and said predetermined position.

23. A cable slack detection and compensation apparatus as claimed in claim 17, wherein one of said body parts has a slot extending longitudinally therein, and the other of said body parts has a member projecting into said slot for defining said sliding movement with said slot, said slot and said member providing said connecting means; and one of said body parts has a stop, and the other of said body parts has a shoulder facing in opposition to said stop, said stop and said shoulder cooperating to prevent extending movement beyond said fully extended position.

24. A cable slack detection and compensation apparatus as claimed in claim 23, wherein each of said body parts has a protruding arm, and said biasing means includes a spring with one end thereof connected to said protruding arm of one of said body parts and an opposite end thereof connected to said arm of the other body part; and one of said body parts includes a mounting portion for mounting said responsive means to determine the extent of each of said portions of said range of motion.

25. A method of detecting and compensating for slack in a cable used for lifting and lowering an object, said method comprising the steps of:

providing an apparatus including a first body portion having a first planar portion, and a second body portion having a second planar portion, and means for connecting said two body portions to each other so that they are movable relative along said planar portions thereof to each other to and from a first position in which said body portions are fully extended with respect to each other, and a second position in which said body portions are fully retracted with respect to each other, said first and second positions and positions therebetween defining a range of movement of said body portions, and means for generating a warning signal when said body portions retract from said first position toward said second position to a predetermined position;

connecting one of said body portions to said cable and the other of said body portions to said object;

biasing said body portions toward said second position against tension in said cable, whereby when said cable becomes slack, said biasing means moves said body portions from said first position toward said second position in order to take up slack in said cable;

sensing when said body portions retract from said first position to said predetermined position; and causing said generating means to generate said warning signal upon sensing that said body portions have retracted to said predetermined position.

* * * * *